United States Patent [19]

White

[11] Patent Number: 4,999,874

[45] Date of Patent: Mar. 19, 1991

[54] DRAPERY ROD ASSEMBLY AND COVER

[76] Inventor: Gerald N. White, 315 N. Edgehill, Youngstown, Ohio 44515

[21] Appl. No.: 482,553

[22] Filed: Feb. 21, 1990

[51] Int. Cl.[5] ..... A47H 1/04

[52] U.S. Cl. ..... 16/95 D; 16/96 D

[58] Field of Search ..... 16/87.4 R, 95 D, 96 D

[56] References Cited

U.S. PATENT DOCUMENTS

| | | | |
|---|---|---|---|
| 617,203 | 1/1899 | Taylor | 16/87.4 R |
| 838,867 | 12/1906 | Calus | 16/87.4 R |
| 3,643,288 | 2/1922 | Olivari | 16/95 |
| 3,713,473 | 1/1973 | Ford | 160/345 |
| 4,782,554 | 11/1988 | Lawson | 16/87 |

*Primary Examiner*—Richard K. Seidel
*Assistant Examiner*—Carmine Cuda
*Attorney, Agent, or Firm*—Harpman & Harpman

[57] ABSTRACT

A drapery rod assembly includes a telescopically adjustable relatively narrow rod of a height greater than heretofore conventional drapery rods and formed in an exaggerated C-shape with a vertical body member having inturned flanges on its upper and lower longitudinal edges. End caps are provided for registry over the ends of the telescopic rod sections and are apertured so that the drapery rod may be mounted on supporting brackets. A longitudinally split tubular member has oppositely disposed outturned angular flanges along the split therein engageable in the inturned flanges of the drapery rod so as to form an enlarged outwardly bowed shape. A foam filler is positioned in sections of the longitudinally split shape to hold the same in engagement with the drapery rod flanges.

5 Claims, 1 Drawing Sheet

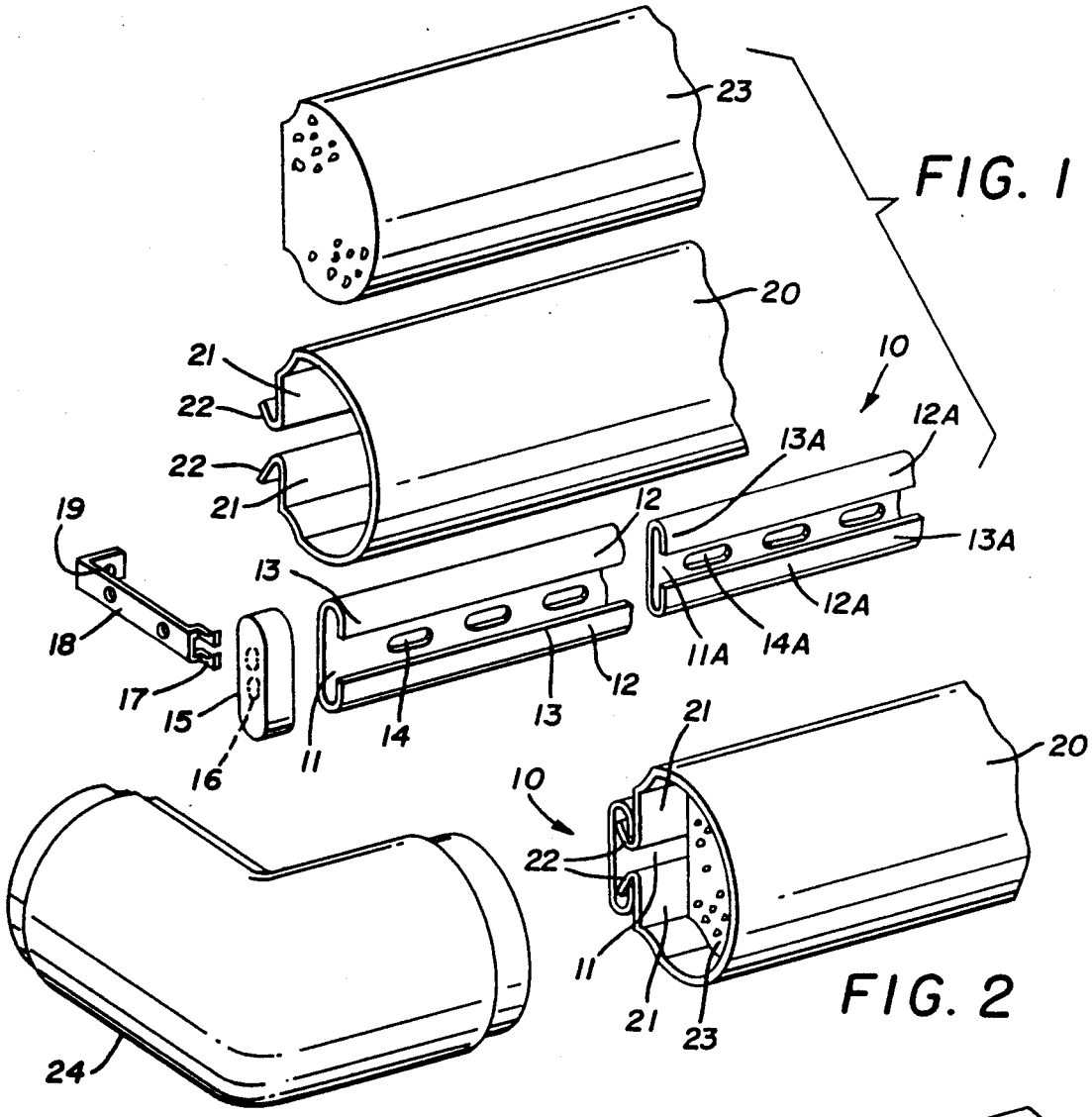
FIG. 1
FIG. 2
FIG. 4
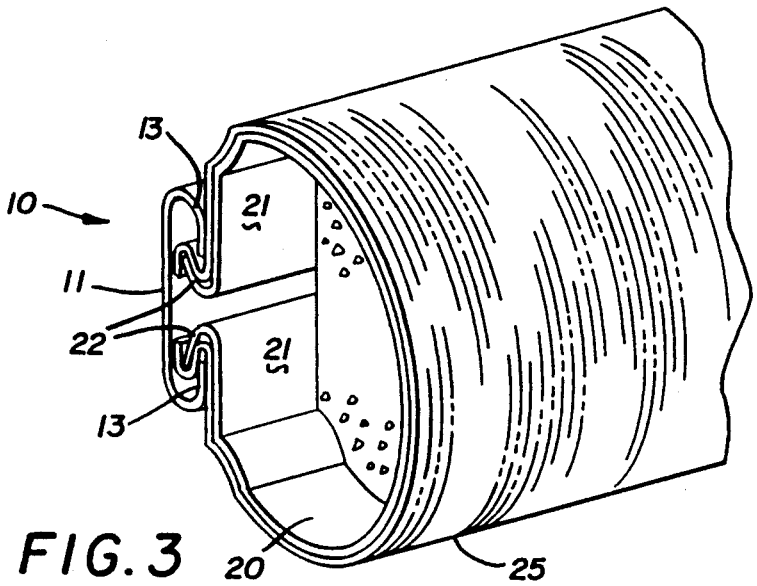
FIG. 3

DRAPERY ROD ASSEMBLY AND COVER

BACKGROUND OF THE INVENTION

1. Technical Field

This invention relates to drapery or curtain rods as used for supporting draperies or curtains with respect to windows in a dwelling house or the like.

2. Description of the Prior Art

Prior structures of this type are disclosed in U.S. Pats. 3,643,288, 3,713,473, and 4,782,554.

This invention utilizes a considerably stronger structure than the prior art which is achieved by a uniquely formed telescopic drapery rod and a cover portion engageable therewith which considerably reinforces the drapery rod and enables considerably longer lengths of drapery rods to be used without supports intermediate their end portions.

SUMMARY OF THE INVENTION

This invention discloses an improved telescopic drapery rod and a split circular member engageable therewith to completely alter the appearance thereof and reinforce the drapery rod structure and at the same time enable the drapery rod structure to carry decorative fabric in the manner of a valance or cornice, the decorative fabric preferably being the same as the drapes suspended from the drapery rod assembly. The drapery rod and the reinforcing decorative cover are preferably formed of a substantially greater height than drapery rods heretofore used so that the improved rod and cover are of a size that eliminates the need of a separate valance or cornice in a decorative window treatment.

DESCRIPTION OF THE DRAWINGS

FIG. 1 is an exploded perspective view of the several parts of the drapery rod assembly and cover with parts broken away;

FIG. 2 is a perspective elevation of an end portion of the assembled drapery rod and cover and foam filler;

FIG. 3 is an enlarged perspective view of an end portion of the improved drapery rod and cover showing decorative fabric positioned thereon and held thereby; and FIG. 4 is a corner section and cover by which the ornamental and structural features of the improved drapery rod are carried around a right angular corner and positioned over mounting brackets supporting the drapery rod assembly.

DESCRIPTION OF THE PREFERRED EMBODIMENT

In the form of the invention disclosed herein, a telescopic drapery rod generally indicated at 10 has vertically positioned body members 11 and 11A, the vertical height of the body members 11 and 11A being slightly different so that they can be telescopically engaged in one another as will occur to those skilled in the art. The overall height of the vertical body member 11 is preferably about five inches and each of the vertical body members 11 and 11A have oppositely disposed U-shaped longitudinally edge sections 12 and 12A which extend forwardly from the vertical body members 11 and 11A respectively to form oppositely disposed vertically spaced longitudinally extending flanges 13 and 13A. A plurality of longitudinally spaced slots 14 and 14A are formed in the vertical body members 11 and 11A so that drapery hooks or the like may be engaged therein to support draperies therefrom. End caps 15 are apertured as at 16 so that vertically spaced hooks 17 on the outer ends of support brackets 18 may be engaged therein to support the drapery rod asssembly. The innermost ends of the support brackets 18 are provided with right angular flanges 19 which are apertured to receive fasteners by which the support brackets 18 can be attached to a supporting surface at the sides of or above a window opening or the like over which the drapery rod assembly and cover is positioned.

Still referring to FIG. 1 of the drawings, a split tubular cover 20 is illustrated which is assembled to the telescopic drapery rod 10 as hereinafter described. The diameter of the split tubular cover 20 is substantially greater than the overall height of the drapery rod 11 and the split tubular cover is provided with oppositely disposed vertical flanges 21 on the longitudinal edges defining the split therein which vertical flanges 21 extend into oppositely disposed angularly positioned secondary flanges 22 which with the vertical flanges 21 define substantially V-shaped configurations that are engageable when the split tubular cover is distorted to form a smaller diameter and the secondary flanges 22 engaged in the longitudinally extending flanges 13 and 13A respectively of the telescopic drapery rod body members 11 and 11A. Elongated sections of plastic foam 23 of an overall size to register in the split tubular cover 20 when it is in expanded form as illustrated in FIG. 2 of the drawings are preferably positioned in the end and middle sections of the split tubular cover 20 when the drapery rod assembly is complete. The elongated sections of foam thus insure the maintenance of the desired shape of the split tubular cover 20 by its continual forceful engagement of its flanges 21 and 22 on the oppositely disposed flanges 12 and 12A and 13 and 13A respectively of the drapery rod 10.

By referring now to FIG. 2 of the drawings, it will be seen that the drapery rod 10 is illustrated with a cover portion 20 thereon and having a section of the plastic foam 23 positioned inwardly of one end thereof. It will be seen that the V-shaped configurations formed by the vertically and angularly disposed flanges 21 and 22 are tightly engaged on the edges of the longitudinally extending flanges 13 and 13A of the drapery rod 10 which position is secured by the presence of the elongated section of the plastic foam 23, it being understood that similar elongated sections are positioned midway of the drapery rod assembly and at the opposite end thereof.

By referring to FIG. 4 of the drawings, an L-shaped corner section 24 is illustrated which is preferably molded of synthetic resin and of a overall size and shape matching the overall size and shape of the drapery rod assembly seen in FIG. 2 of the drawings. The corner section and cover 24 has end portions of slightly reduced size so as to be slidably engageable in the open ends of the cover 20 when the same are provided with the end caps 15 and of a size to extend at a right angle to the cover 20 and thereby cover the support bracket 18 which is positioned thereinunder.

It will be understood that in completing the assembly, the end caps 15 apertured at 16 to receive the hooks 17 on the support brackets will be positioned on the ends of the drapery rod 10 and will be positioned so as to be covered by the corner section and cover member 24. It will be understood that a duplicate end corner section and cover 24 will be installed at the opposite end of the drapery rod.

By referring now to FIG. 3 of the drawings, it will be seen that the novel enlarged drapery rod 10 is illustrated with the split tubular cover 20 covered with a section of decorative fabric 25 which extends over the entire outer surface of the split tubular cover 20 including the vertical flanges 21 inwardly of its longitudinal edges which are in turn defined by the angularly disposed flanges 22. The arrangement is such that when the split tubular cover 20 is distorted as by moving the flanges 21 and 22 which form the longitudinal edges of the split tubular cover 20 toward one another, the decorative fabric 25 can be readily positioned thereover and the oppositely disposed flanges 21 and 22 respectively along with the section of decorative fabric 25 moved into position inwardly of the oppositely disposed flanges 13 on the body member 11 of the drapery rod 10. Upon release of the split tubular cover 20 it resumes its normal shape and tightly engages the V-shaped cavities defined by the flanges 21 and 22 on each of its longitudinal edges over the oppositely disposed flanges 13 on the body member 11 of the drapery rod 10. The same reinforcing action of the drapery rod 10 is present and in addition the section of decorative fabric 25 is held in position throughout the length of the drapery rod 10 where it forms an attractive valance or cornice with respect to a window opening on which the improved drapery rod assembly and cover is positioned.

It will be understood by those skilled in the art that the drapes and/or curtains also used on a window in conjunction with the ornamental valance or cornice formed by the drapery rod assembly are supported by the same drapery rod and blend attractively into the outwardly and upwardly bowed split tubular cover with the decorative fabric 25 thereon.

An example of a preferred embodiment of the drapery rod disclosed herein comprises forming the telescopic rod sections of an overall height of at least four inches with the vertically spaced oppositely disposed U-shaped flanges on the upper and lower longitudinal edges thereof being spaced forwardly of the rod sections at least three-eighths of an inch with the tubular reinforcing member open along its entire length for part of its circumference being of an overall height of at least six inches.

In summary, the drapery rod assembly and cover disclosed herein may be formed in substantially larger sizes than has heretofore been possible with the prior art drapery rod constructions, both with respect to the actual height of the drapery rod and the split tubular cove thereof and the length of the multiple reinforced drapery rod itself.

Having thus described my invention, what I claim is:

1. The combination of an elongated vertically positioned telescopic drapery rod of a known height having vertically spaced oppositely disposed U-shaped flanges on its upper and lower longitudinal edges and an elongated distorted resilient tubular reiniorcing member open along its entire length for a part of its circumference and of a size greater than the known height of said drapery rod, means on the longitudinal edges of said open tubular reinforcing member engageable when said reinforcing open tubular member is distorted to engage said oppositely disposed U-shaped flanges on said drapery rod so as to urge the same apart and cover said rod and its U-shaped flanges, means on the ends of said drapery rod and a pair of brackets engaging said means on the ends of said drapery rod to secure the same to a wall structure.

2. The combination set forth in claim 1 and wherein said oppositely disposed U-shaped flanges on the upper and lower edges of said drapery rod are of a known width and the height of said drapery rod is at least sixteen times said known width.

3. The combination set forth in claim 1 and wherein said means on the longitudinal edges of said open tubular reinforcing member comprise oppositely disposed inturned flanges having oppositely disposed angularly positioned outturned flanges extending therefrom and defining the longitudinal edges of said open tubular reinforcing member.

4. The combination set forth in claim 1 and wherein said elongated vertically positioned telescopic drapery rod comprises an elongated flat body member, oppositely disposed U-shaped flanges on its upper and lower longitudinal edges and having a plurality of slots in said flat body member longitudinally spaced with respect to one another for the reception of drapery hooks and wherein said tubular reinforcing member open along its entire length for part of its circumference engaged in said oppositely disposed U-shaped flanges acts to stiffen said flat body member and cover the same and the U-shaped flanges and the slots so as to conceal drapery hooks engaged therein.

5. The combination of an elongated vertically positioned drapery rod of a known height having vertically spaced oppositely disposed inturned flanges on its upper and lower longitudinal edges and an elongated distortable resilient split tubular reinforcing member of a height greater than the known height of said drapery rod, oppositely disposed outturned cross sectionally V-shaped flanges on the longitudinal edges of said split tubular reinforcing member engageable when said split reiniorcing tubular member is distorted and engaged in said oppositely disposed U-shaped flanges on said drapery rod so as to urge said oppositely disposed U-shaped flanges apart in a first stengthening action and cover said rod and its U-shaped flanges to provide an upward and outwardly bowed surface on which decorative fabric may be secured by said engagement of said V-shaped flanges on said oppositely disposed U-shaped flanges of said drapery rod.

* * * * *